US007434762B2

(12) United States Patent
Hatalsky et al.

(10) Patent No.: US 7,434,762 B2
(45) Date of Patent: Oct. 14, 2008

(54) RETRACTABLE THRUST VECTOR CONTROL VANE SYSTEM AND METHOD

(75) Inventors: William M. Hatalsky, Tucson, AZ (US); Gregory A. Mitchell, Tucson, AZ (US)

(73) Assignee: Raytheon Company, Lexington, MA (US)

( * ) Notice: Subject to any disclaimer, the term of this patent is extended or adjusted under 35 U.S.C. 154(b) by 144 days.

(21) Appl. No.: 11/039,279

(22) Filed: Jan. 18, 2005

(65) Prior Publication Data

US 2008/0179449 A1 Jul. 31, 2008

(51) Int. Cl.
*F41G 7/00* (2006.01)
*F42B 15/01* (2006.01)
*F42B 12/00* (2006.01)

(52) U.S. Cl. ..... 244/3.21; 244/3.1; 244/3.15; 239/265.11; 239/265.19; 60/228; 60/230

(58) Field of Classification Search ..... 244/3.1–3.3, 244/51, 52; 60/228–232; 239/265.11–265.43
See application file for complete search history.

(56) References Cited

U.S. PATENT DOCUMENTS

| | | | | | |
|---|---|---|---|---|---|
| 4,131,246 | A | * | 12/1978 | Rotmans | 244/3.22 |
| H384 | H | * | 12/1987 | Dillinger et al. | 60/230 |
| 5,072,891 | A | * | 12/1991 | Cavalleri et al. | 244/3.21 |
| 5,125,596 | A | * | 6/1992 | Cavalleri | 244/3.22 |
| 5,320,304 | A | | 6/1994 | Danielson | |
| 6,450,443 | B1 | * | 9/2002 | Kim | 244/3.23 |
| 6,548,794 | B2 | | 4/2003 | Facciano et al. | |

* cited by examiner

*Primary Examiner*—Bernarr E Gregory
(74) *Attorney, Agent, or Firm*—Renner, Otto, Boisselle & Sklar, LLP

(57) ABSTRACT

A retractable thrust vector control system (10) for a rocket motor (26) that can generate an exhaust plume comprises at least one control vane (12) connectable to an attitude control assembly (20) that rotates the vane (12) about a control axis (44). The system also includes a retraction mechanism (14) for withdrawing the control vane (12) along the control axis (44) from an extended position at least partially within a path of a rocket exhaust plume and a retracted position substantially out of a path of a rocket exhaust plume.

20 Claims, 5 Drawing Sheets

RETRACTABLE THRUST VECTOR CONTROL VANE SYSTEM AND METHOD

FIELD OF THE INVENTION

This invention relates to a control system for a rocket-powered vehicle, and more particularly, to a thrust vector control system for temporarily steering a missile after launch, as well as a method of operating such a system.

BACKGROUND

To control the flight of a missile or other rocket-powered vehicle after launch, thrust vector control (TVC) vanes can be placed in the path of the rocket motor's exhaust plume to direct the exhaust and thereby control the direction of the thrust and the flight of the missile. But placing TVC vanes in the exhaust plume reduces the efficiency of the rocket motor, which in turn limits the missile's maximum range. Once the missile reaches an aerodynamic control velocity, however, external aerodynamic control surfaces or fins can be used to control the missile, and the control vanes can be removed from the exhaust plume to minimize or eliminate their effect on the rocket motor's efficiency and to maximize its range.

Once the missile reaches a velocity where the external aerodynamic control surfaces can control the missile, the TVC vanes can be removed from the exhaust plume to minimize their effect on the rocket motor's efficiency, thereby increasing the missile's range. The TVC vanes can be removed from the exhaust plume using (1) dissolvable TVC vanes that erode in the rocket plume, or (2) retractable TVC vanes that can be moved out of the path of the rocket plume, or both. A dissolvable thrust vector control vane is disclosed in U.S. Pat. No. 6,548,794, for example, the entire disclosure of which is hereby incorporated herein by reference. Once the missile reaches the aerodynamic control velocity, the vanes dissolve in the exhaust plume, thereby removing their effect on the rocket motor's efficiency. These dissolvable control vanes require a specific type of solid propellant rocket motor, however, specifically a two-stage motor that changes from a non-corrosive propellant to a corrosive propellant, to quickly and effectively erode all the vanes simultaneously.

An example of a retractable TVC vane is disclosed in U.S. Pat. No. 5,320,304, which also is incorporated herein by reference in its entirely. The '304 patent discloses an integrated aerodynamic fin and stowable thrust vector reaction steering system, where each TVC vane can be retracted into a hollow space inside a corresponding aerodynamic fin. An extension and retraction linkage and an actuator for each vane are used to insert the vane into the rocket exhaust plume and then withdraw it after the missile reaches an aerodynamic control velocity. The control system for the aerodynamic fins also controls the attitude of the vane in the exhaust plume. For control, the aerodynamic fins rotate about an axis that generally is perpendicular to the longitudinal axis of the missile. The vanes, however, are spaced from that axis. Consequently, control schemes for these vanes must take into account a lateral translation of the vanes that accompanies a change in attitude.

In addition, the extreme environment of a rocket motor exhaust plume means that the TVC vanes often must be made of rare and expensive materials. For a solid propellant rocket, for example, the TVC vanes can be exposed to a 4000+ degree Fahrenheit (2200+ degree Celsius) rocket plume.

SUMMARY OF THE INVENTION

The present invention provides a retractable TVC system that affords missile control at low air speed and maximizes missile range, without requiring special propellant, reduces the heat-resistant material requirements, and delivers vane attitude control without vane translation. The TVC system provided by the present invention includes an innovative mechanism for retracting the TVC vanes from the rocket motor plume along the attitude control axis when they are no longer needed for flight stability or maneuverability.

According to one aspect of the invention, a retractable thrust vector control system for a rocket motor that can generate an exhaust plume comprises at least one control vane connectable to an attitude control assembly or other means for controlling the attitude of the control vane that is rotatable about a control axis, and a retraction mechanism or other means for withdrawing the control vane along the control axis from an extended position at least partially within a path of a rocket exhaust plume to a retracted position substantially out of a path of a rocket exhaust plume.

The present invention also provides a method of operating a thrust vector control system, comprising the steps of controlling a plurality of control vanes extending into a path of a rocket motor exhaust plume by rotating the vanes along respective control axes, and retracting the control vanes along respective control axes to remove the control vanes from the path of the exhaust plume.

The foregoing and other features of the invention are hereinafter fully described and particularly pointed out in the claims, the following description and the annexed drawings setting forth in detail an illustrative embodiment of the invention, such being indicative, however, of but one of the various ways in which the principles of the invention may be employed.

DETAILED DESCRIPTION

Figure 1:
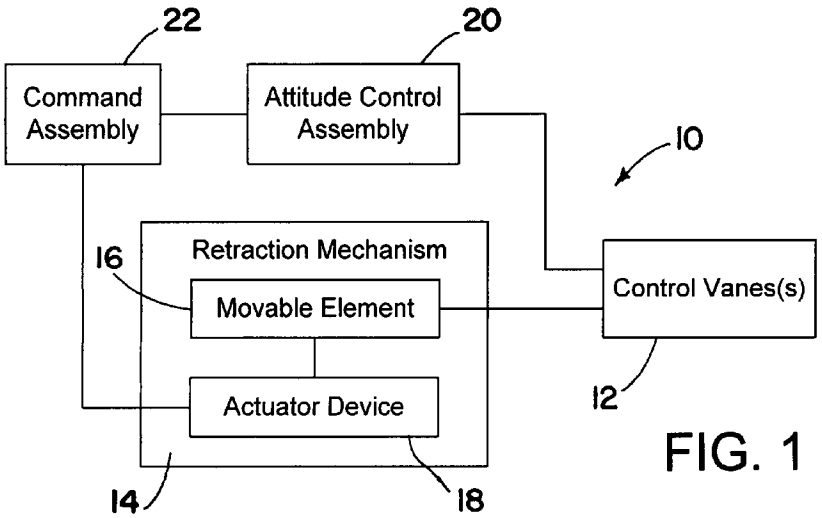
FIG. 1 is a schematic view of a system that includes a retractable thrust vector control (TVC) system in accordance with the invention.

With reference to the drawings, and initially to FIG. 1, a retractable thrust vector control (TVC) system 10 according to the invention includes at least one thrust vector control vane 12 and a retraction mechanism 14 for withdrawing the control vane(s) from a rocket motor plume along an attitude control axis when the control vane(s) are no longer needed for flight stability or maneuverability. The one or more control vanes 12 typically are initially deployed in an extended or "plume-engaged" position within the path of a rocket motor exhaust plume and are rotatable about the attitude control axis to effect the rocket motor plume.

The retraction mechanism 14 includes a movable element 16 and an actuator 18 to activate the movable element 16 to at least move the control vane(s) 12 from the in-the-plume condition in the plume-engaged position to a retracted-from-the-plume condition in a retracted position with the control vane(s) removed from the path of the exhaust plume. If desired, the retraction mechanism can also be designed to move the control vane(s) back to the plume-engaged position. The movable element 16 can be a ring, a plate, sliding shafts, rotating linkages, or a combination of mechanisms. In a system where space is extremely limited, for example, a thin plate might work best, whereas, as another example, in a system where cost is critical, a plastic ring might be better suited. The retraction mechanism 14 does not interfere with the rotation action of the control vane(s) within the rocket exhaust plume. The actuator 18 can include a solenoid, an electric motor, a spring, a pyrotechnic device, pressurized gas, or other similar mechanisms or combination of mechanisms. The actuator 18 can be optimized for use with available energy sources, such as a battery, a gas vessel, etc.

The TVC system 10 is employed with a control assembly 20 for controlling the attitude of the control vane or vanes 12 in the exhaust plume by rotating each control vane 12 about the attitude control axis. The control vanes 12 can be driven by dedicated actuators for each control vane, linkages connected to aerodynamic fin actuators, or other designs.

Finally, the retraction mechanism 14 and the control assembly 20 typically are employed with a command mechanism 22, which can include a guidance unit, a predetermined electronic timer, a predetermined mechanical timer, or other means for instructing the control assembly 20 to control the attitude of the control vane(s) 12 or for instructing the retraction mechanism 14 to retract or to insert the control vane(s) 12 from or into the path of the rocket motor plume, or combinations thereof.

Figure 2:
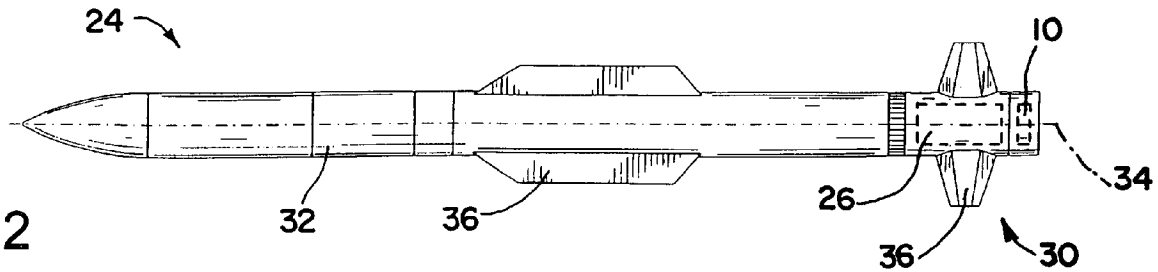
FIG. 2 is a side view of a missile that includes a retractable TVC system in accordance with the invention.

The retractable TVC system 10 thus described can be incorporated into a rocket-powered vehicle, such as a missile 24, as shown in FIG. 2. The missile 24 includes a rocket motor 26 for propelling the missile 24 and a TVC system 10 mounted to the missile 24 such that the one or more control vanes 12 are extendable into a path of the rocket motor's exhaust plume. The rocket motor 26 generally is positioned toward a rear or aft portion 30 of the missile fuselage 32 (i.e., toward the right in FIG. 2). A rocket motor is a reaction engine, i.e., an engine that develops thrust by the focused expulsion of matter, especially ignited fuel gases, that forms an exhaust plume. When the missile 24 is flying in a straight line, the rocket exhaust plume generally extends from the rear end 30 of the missile 24 along a path that is parallel to the longitudinal axis 34 of the fuselage 32. The control vanes can be controllably rotated to deflect the exhaust plume, and thereby control the flight of the missile 24 immediately after launch. Once the missile 24 attains an aerodynamic control velocity, however, one or more aerodynamic control surfaces formed by wings or fins 36 extending outwardly from an external surface of the fuselage 32 can control the missile 24, thereby allowing the TVC system 10 to withdraw the vanes 12 from the plume.

Figure 3:
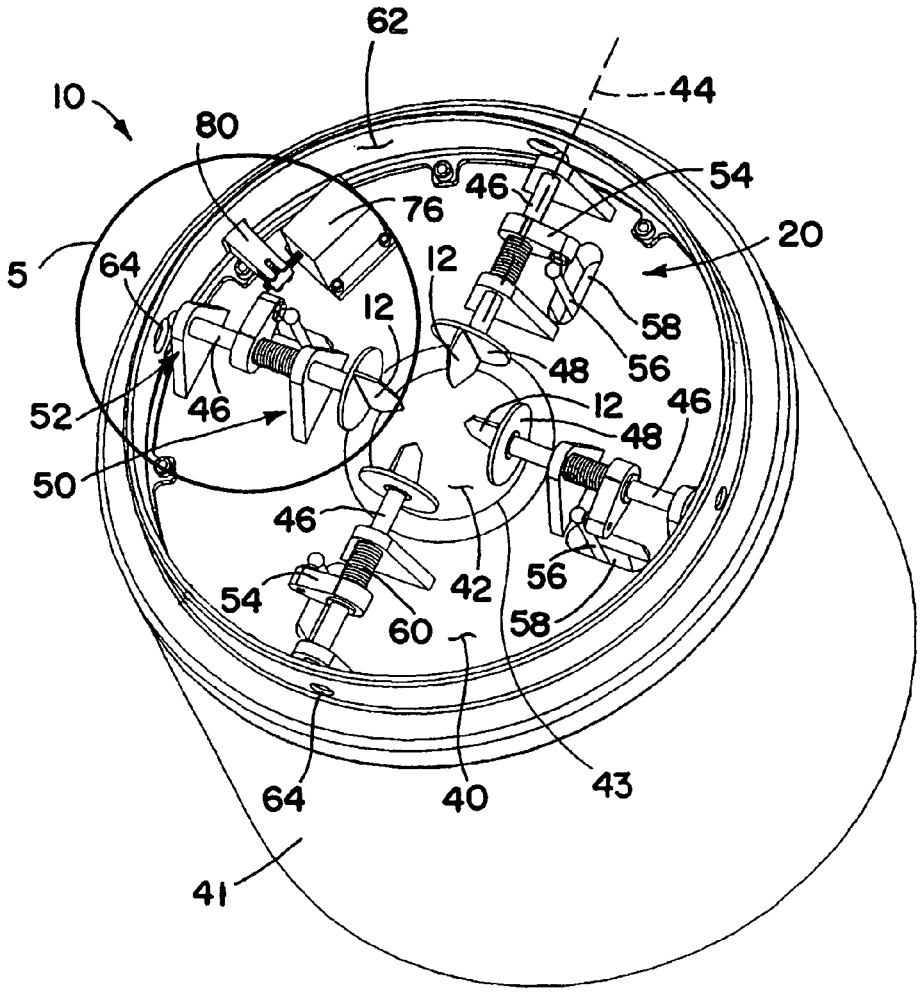
FIG. 3 is a perspective view of a retractable TVC system according to the invention, with the control vanes in an extended position.
Figure 4:
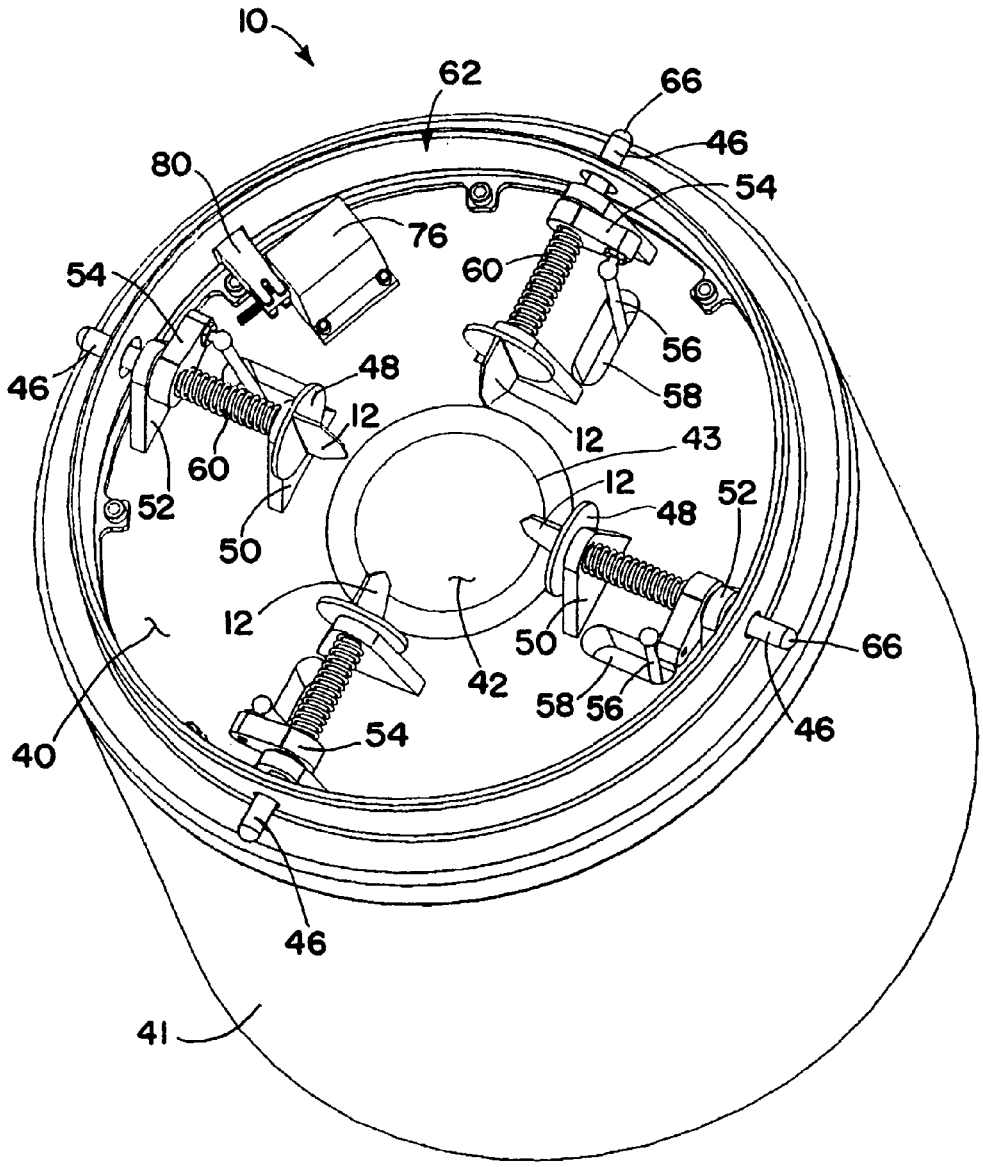
FIG. 4 is a perspective view of a retractable TVC system according to the invention, with the control vanes in a retracted position.
Figure 5:
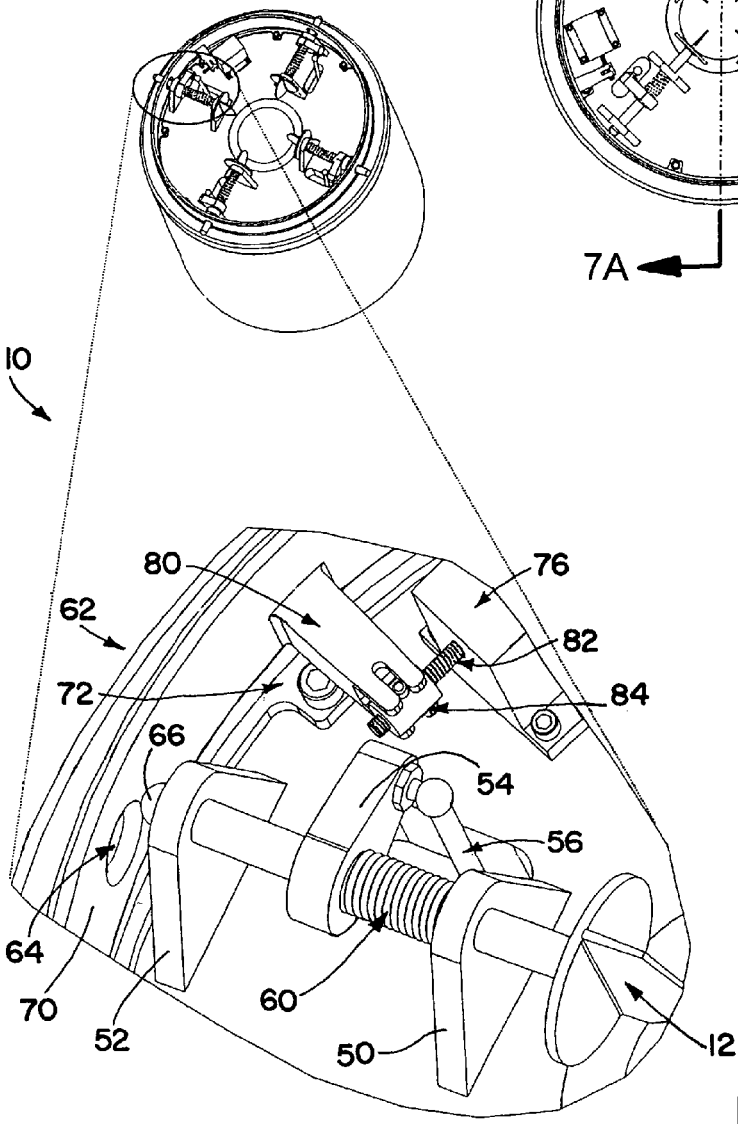
FIG. 5 is an enlarged perspective view of the drive train from the system of FIG. 3.

Turning now to one embodiment of the TVC system shown in FIGS. 3-5, the TVC system 10 according to the invention includes at least one thrust vector control vane 12 movable between an extended or plume-engaged position at least partially within a path of the rocket exhaust plume (FIG. 3) and a retracted position substantially out of the path of the rocket exhaust plume (FIG. 4). The illustrated system 10 includes a plurality of control vanes 12, specifically four control vanes, mounted to the aft face 40 of a control section 41. The control vanes 12 typically are equally circumferentially spaced around a circular exhaust opening 42 through which the exhaust plume exits a blast tube 43, Generally, the control vanes are identical and in the illustrated embodiment each vane 12 has a wedge shape cross-section. The cross-sectional shape of each control vane is not limited to a wedge shape, however, and each control vane does not have to be identical in size or shape.

An attitude control assembly 20 rotates each control vane 12 about a control axis 44, and a retraction mechanism withdraws the control vane 12 along the control axis 44 from the extended position to the retracted position. The illustrated control vane 12 is mounted on a vane shaft 46 that extends along the control axis 44, such that the control axis extends through a portion of the control vane 12. The base of the control vane 12 extends perpendicularly from a blast disk 48 that extends radially outward from one end of the vane shaft 46. The vane shaft 46 is supported in turn by a pair of spaced apart inner and outer bearing towers 50, 52 mounted to the aft face 40 of the control section 41 for axial and rotational movement relative to the exhaust opening 42. The bearing towers 50, 52 can include bearings to facilitate movement of the vane shaft 46 relative to the bearing towers. The bearing towers 50, 52 space the control vane 12 from the aft face 40 of the control section 41 so that the vane 12 and blast disk 48 can move without interference with the face 40.

The attitude control assembly 20 controls the rotational position of the vane shaft 46 and the attitude of each control vane 12 through a linkage. In the illustrated embodiment, the linkage includes a crank arm 54 attached to the vane shaft 46 that extends transverse to the control axis 44, and a pushrod 56 extending through a drive slot 58 in the aft face 40 of the control section 41. The pushrod 56 is connected to the crank arm 54 with a ball joint type connection. A similar type connection can be used at the other end of the pushrod 56, such as to an aerodynamic fin actuator, such that movement of the crank arm 56 can rotate the control vane 12 about the control axis 44.

The retraction mechanism 14 (FIG. 1) controls the axial position of the vane shaft 46 and the control vane 12. The drive slot 58 has a length dimension that is parallel to the attitude control axis 44. The drive slot 58 and the ball joint connections of the pushrod 56 permit translation of the vane shaft 46 along the control axis 44, and thus movement of the control vane 12 is enabled along the control axis 44 between the extended and retracted positions.

The retraction mechanism 14 (FIG. 1) moves the vane shaft 46 and the control vane 12 axially along the control axis 44 between the extended position and the retracted position. The retraction mechanism 14 (FIG. 1) includes a movable element 16 (FIG. 1) that holds the control vane 12 in the extended position and moves to allow the vane 12 to move from the extended position. The retraction mechanism also includes the actuator 18 (FIG. 1) for moving the control vane 12 toward the retracted position. In the illustrated embodiment, the actuator includes a spring, specifically a compression spring 60 mounted on the vane shaft 46 between the inner bearing tower 50 and the crank arm 56. The spring 60 biases the vane shaft 46 against a movable element in the form of a rotatable bearing ring 62. The bearing ring 62 includes an aperture or hole 64 sized for receipt of a distal end of the vane shaft 46. By rotating the bearing ring 62, the hole 64 can be aligned with the control axis 44, whereby the spring 60 pushes the vane shaft 46 into the hole 64, thereby withdrawing the control vane 12 from the extended position depicted in FIG. 3 to the retracted position shown in FIG. 4. An outer, distal end 66 (FIG. 4) of the vane shaft 46 is rounded or otherwise tapered to minimize friction with the bearing ring 62.

Figure 6:
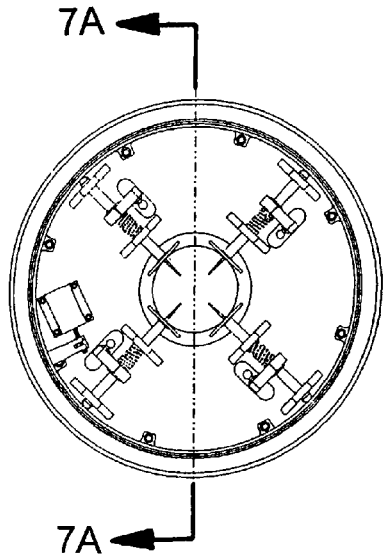
FIG. 6 is a rear end view of the missile of FIG. 2 showing the retractable TVC system according to the invention.
Figure 7A:
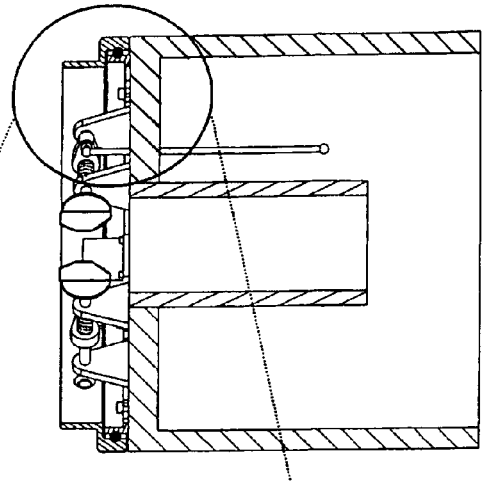
FIG. 7A is a cross-sectional view of the TVC system as viewed along line 7A-7A in FIG. 6.
Figure 7B:
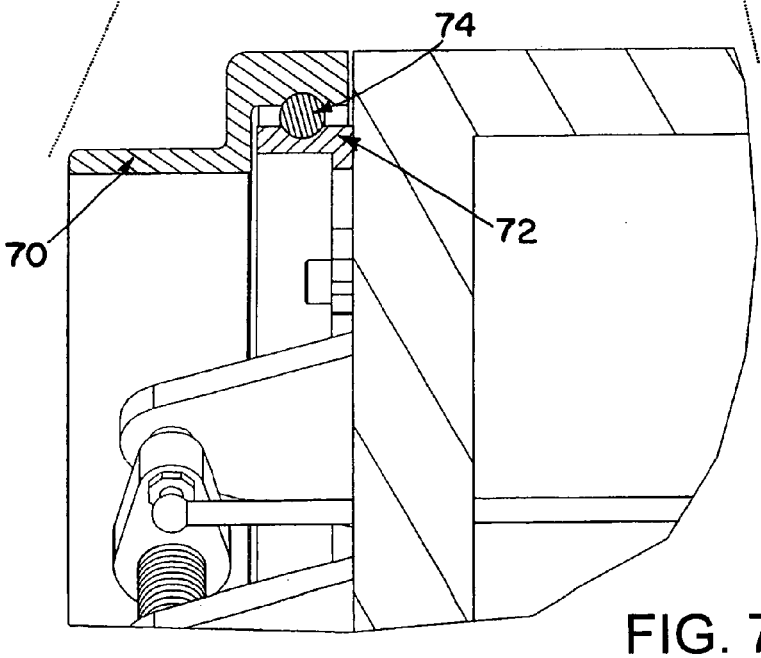
FIG. 7B is an enlarged partial cross-sectional view of a bearing ring portion of the TVC system of FIG. 5A.

Further details of the illustrated movable element of the retraction mechanism 14, the bearing ring 62, can be seen in FIGS. 6, 7A and 7B. The bearing ring 62 includes a rotating ring or outer bearing race 70, a fixed mounting ring or inner bearing race 72 secured to the aft face 40 of the control section 41, and a plurality of ball bearings 74 in a raceway therebetween that facilitate rotation of the rotating ring 70 relative to the fixed ring 72. The aperture or hole 64 is formed in the rotating ring 70 and can be a through-hole or can have a closed end that acts as a stop to stop the vane shaft at the retracted position. Upon rotation of the rotating ring 70 to align the hole 64 with the vane shaft 46, the compression spring 60 will push the vane shaft 46 into the hole 64, thereby withdrawing the control vane 12 from the path of the rocket exhaust plume.

The bearing ring 62 is driven by a prime mover 76, such as an electric motor or solenoid or electro-explosive piston actuator. The actuator in the illustrated embodiment thus includes the prime mover 76, which cooperates with the spring 60 on the vane shaft 46 to move the movable member, the bearing ring 62, and to withdraw the vane shaft 46 along the attitude control axis 44 into the hole 64 in the bearing ring 62. The prime mover 76 in the illustrated embodiment is an electric motor, which is connected to the bearing ring 62 via a control arm 80 extending inwardly from the rotating ring 70 with a ball screw 82 and nut 84 arrangement.

Until shortly after rocket motor initiation, the control vanes 12 are in the extended or "plume-engaged" position as shown in FIG. 3. Once the missile 24 (FIG. 2) no longer requires the control vanes 12 for steering control, the prime mover 76 can rotate the ball screw 82, which rotates against the ball nut 84 held in the rotating ring's control arm 80 to rotate the rotating ring 70 to line up the respective holes 64 with the vane shafts 46. Once the rotating ring 70 has traveled a predetermined distance that aligns the vane shafts 46 with respective holes 64, the spring-loaded shafts 46 will retract into the respective holes 64 in the rotating ring 70. The control vanes 12 are then positioned in the "retracted from the plume" state as shown in FIG. 4.

Thus a method of operating a thrust vector control system comprises the steps of controlling a plurality of control vanes extending into a path of a rocket motor exhaust plume by rotating the vanes along respective control axes, and retracting the control vanes along respective control axes to remove the control vanes from the path of the exhaust plume. The retracting step can include rotating a ring that is radially outward of the control vanes, as in the illustrated embodiment, but is not limited to rotating a ring. Another step includes stopping the control vanes at a retracted position out of the path of the exhaust plume.

In summary, the present invention provides an effective thrust vector control system at a minimal cost using simple components. The resulting system can be used in small, stationary-launch missile systems, but by no means is the present invention limited to such systems. The TVC system provided by the present invention is inherently flexible in that it can be used with different types of missiles or other rocket-powered vehicles. Additionally, the system provided by the present invention also relaxes the requirement for special heat-capable materials by reducing the length of time that the control vanes are exposed to the rocket motor plume. By suitably implementing appropriate cam surfaces in the design of the moveable outer ring of the bearing, the invention also can return the vanes into engagement with the rocket motor plume, thus allowing selected use of the vanes for missile steering at any time during flight.

Although the invention has been shown and described with respect to a certain embodiment, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer that performs the specified function of the described integer (i.e., that is functionally equivalent), even though not structurally equivalent to the disclosed structure that performs the function in the herein illustrated exemplary embodiment of the invention.

What is claimed is:

1. A retractable thrust vector control system for a rocket motor that generates an exhaust plume, comprising a control vane connected to an attitude control assembly, where the control assembly rotates the control vane about a control axis to control the attitude of the control vane, and a retraction mechanism for withdrawing the control vane in a direction along the control axis from an extended position at least partially within a path of the rocket exhaust plume to a retracted position substantially out of the path of the rocket exhaust plume.

2. A system as set forth in claim 1, wherein the retraction mechanism includes an actuator for moving the control vane toward the retracted position.

3. A system as set forth in claim 2, wherein actuator includes a spring.

4. A system as set forth in claim 3, wherein the spring is a compression spring.

5. A system as set forth in claim 2, wherein the control vane is mounted on a shaft, the shaft is supported by a pair of bearing towers, and the shaft includes a stop that acts against a bearing tower to stop the control vane at the retracted position.

6. A system as set forth in claim 2, wherein the actuator includes a biasing device for biasing the control vane toward the retracted position.

7. A system as set forth in claim 1, wherein the retraction mechanism includes a movable element having a hold position where the control vane is held in the extended position and moves to a release position where the control vane is allowed to move from the extended position.

8. A system as set forth in claim 7, wherein the control vane is mounted on a shaft, the retraction mechanism includes a biasing device for biasing the control vane toward the retracted position, and the movable element includes a circumferential bearing ring having an aperture therein for receipt of a distal end of the shaft, whereby upon rotation of the ring to align the aperture with the shaft, the biasing device will move the shaft into the aperture, thereby withdrawing the control vane from the path of the rocket exhaust plume.

9. A system as set forth in claim 8, wherein the bearing ring is driven by a prime mover connected to the bearing ring via a control arm extending from the bearing ring.

10. A system as set forth in claim 9, wherein the prime mover is an electric motor or an electro-explosive piston actuator or a solenoid.

11. A system as set forth in claim 1, wherein the control vane is mounted on a shaft that extends along the control axis, the shaft having a crank arm extending transverse to the control axis that is connected to the control assembly.

12. A system as set forth in claim 1, including a plurality of circumferentially spaced control vanes, wherein the control axis of each control vane extends along a radial axis.

13. A system as set forth in claim 12, including four control vanes.

14. A system as set forth in claim 1, wherein the control vane is rotatable about a control axis extending transverse to the expected direction of the exhaust plume.

15. A system as set forth in claim 1, further comprising an attitude control assembly connected to the control vane.

16. A missile having a rocket motor for propelling the missile that generates an exhaust plume, and a system as set forth in claim 1 mounted to the rocket motor.

17. A system as set forth in claim 1, wherein the control vane is mounted on a shaft that extends along the control axis, the shaft is supported by a pair of bearing towers, the shaft has a crank arm extending transverse to the control axis that is connected to the control assembly, and a spring is interposed between the crank arm and one of the bearing towers to bias the control vane toward the retracted position.

18. A method of operating a thrust vector control system, comprising the steps of controlling a plurality of control vanes extending into a path of a rocket motor exhaust plume by rotating the vanes along respective control axes, and retracting the control vanes along respective control axes to remove the control vanes from the path of the exhaust plume, wherein the control vanes are arranged circumferentially around the path of the exhaust plume and the retracting step includes rotating a ring that is radially outward of the control vanes.

19. A method as set forth in claim 18, including the step of stopping the control vanes at a retracted position out of the path of the exhaust plume.

20. A retractable thrust vector control system for a rocket motor that generates an exhaust plume, comprising a control vane connected to means for controlling the attitude of the control vane by rotating the control vane about a control axis, and means for withdrawing the control vane in a direction along the control axis from an extended position at least partially within a path of the rocket exhaust plume and a retracted position substantially out of the path of the rocket exhaust plume.

* * * * *